US005520395A

United States Patent [19]

Mondello, Jr.

[11] Patent Number: 5,520,395

[45] Date of Patent: May 28, 1996

[54] SHAPE IDENTIFICATION GAME USING SENSE OF TOUCH

[76] Inventor: Samuel A. Mondello, Jr., 765 Weston Dr., Crystal Lake, Ill. 60014

[21] Appl. No.: 224,871

[22] Filed: Apr. 8, 1994

[51] Int. Cl.[6] ..... A63F 9/00

[52] U.S. Cl. ..... 273/276; 273/157 R; 273/440; 434/259

[58] Field of Search ..... 273/153 R, 156, 273/157 R, 160, 236, 273, 276, 139, 440, 447, DIG. 27; 434/159, 160, 171, 172, 403, 406, 258, 259

[56] References Cited

U.S. PATENT DOCUMENTS 3,484,105 12/1969 Winston ..... 273/440
4,208,052 6/1980 Snow .
4,298,200 11/1981 Kanbar ..... 273/157 R
4,583,742 4/1986 Slinn .
4,840,374 6/1989 Skinner ..... 273/440
4,948,146 8/1990 Snyder et al. ..... 273/276
5,062,637 11/1991 Bianchi .
5,221,094 6/1993 Hanson .
5,288,084 2/1994 Miller ..... 273/440

*Primary Examiner*—William M. Pierce
*Attorney, Agent, or Firm*—Patnaude, Videbeck & Marsh

[57] ABSTRACT

A game has a first plurality of different interlockable play pieces and a second plurality of cards depicting plans for assembling some of the interlockable pieces into a rectangular pattern. The play pieces are placed in a flexible bag having a plurality of access ports, and each player extends a hand through a port into the bag. Players select play pieces from the bag using their sense of touch and assemble the pieces in accordance with the plan shown on their respective cards.

7 Claims, 4 Drawing Sheets

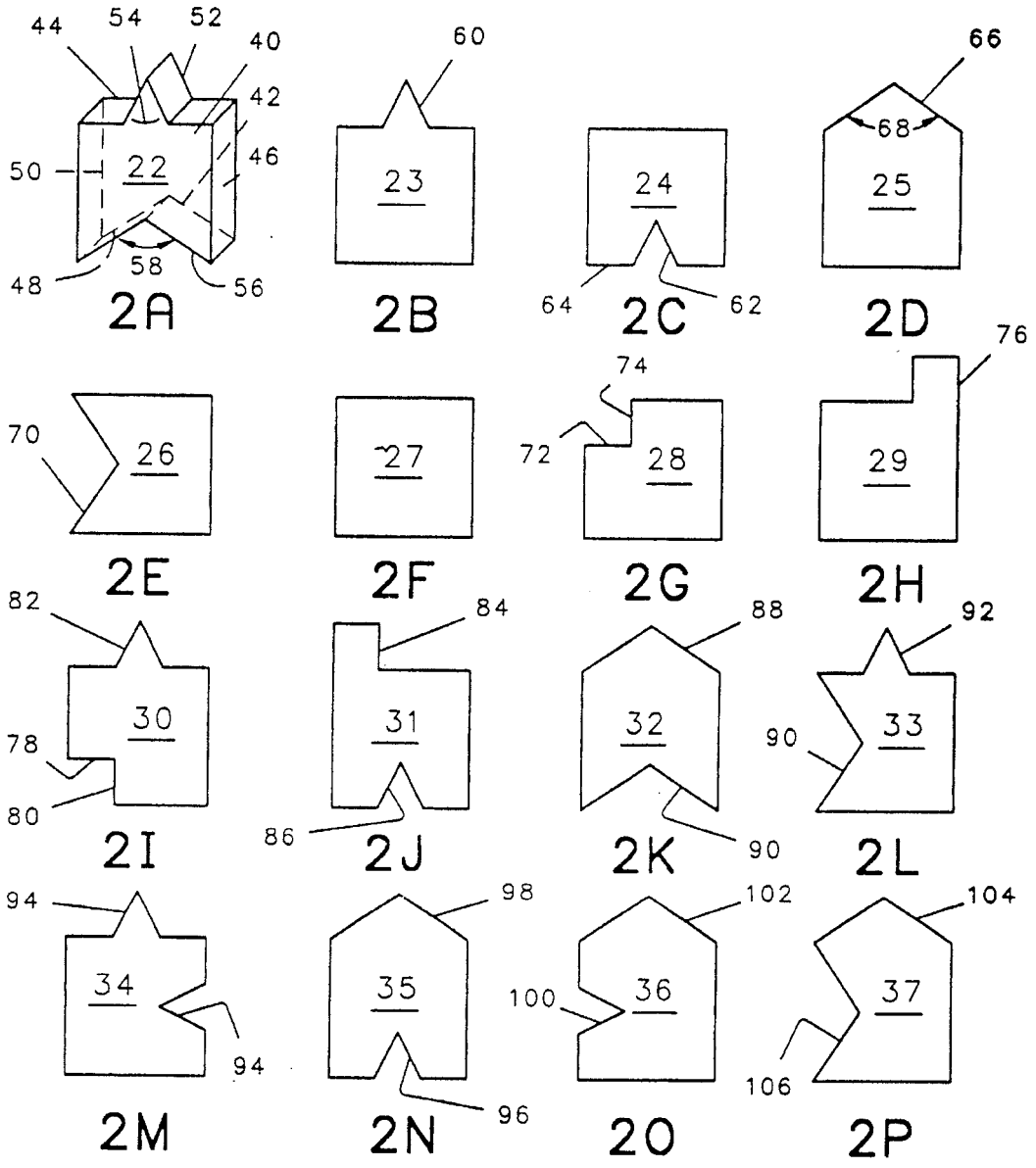
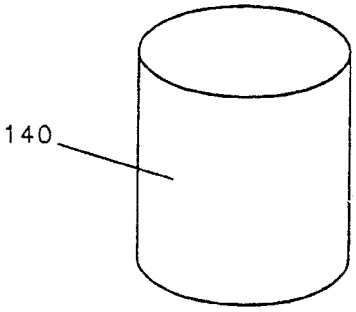
FIG.4
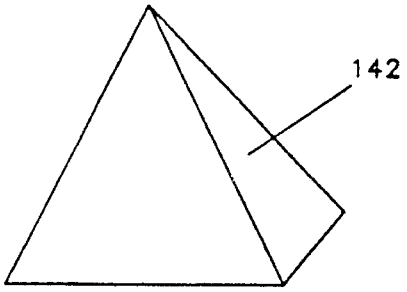
FIG.5

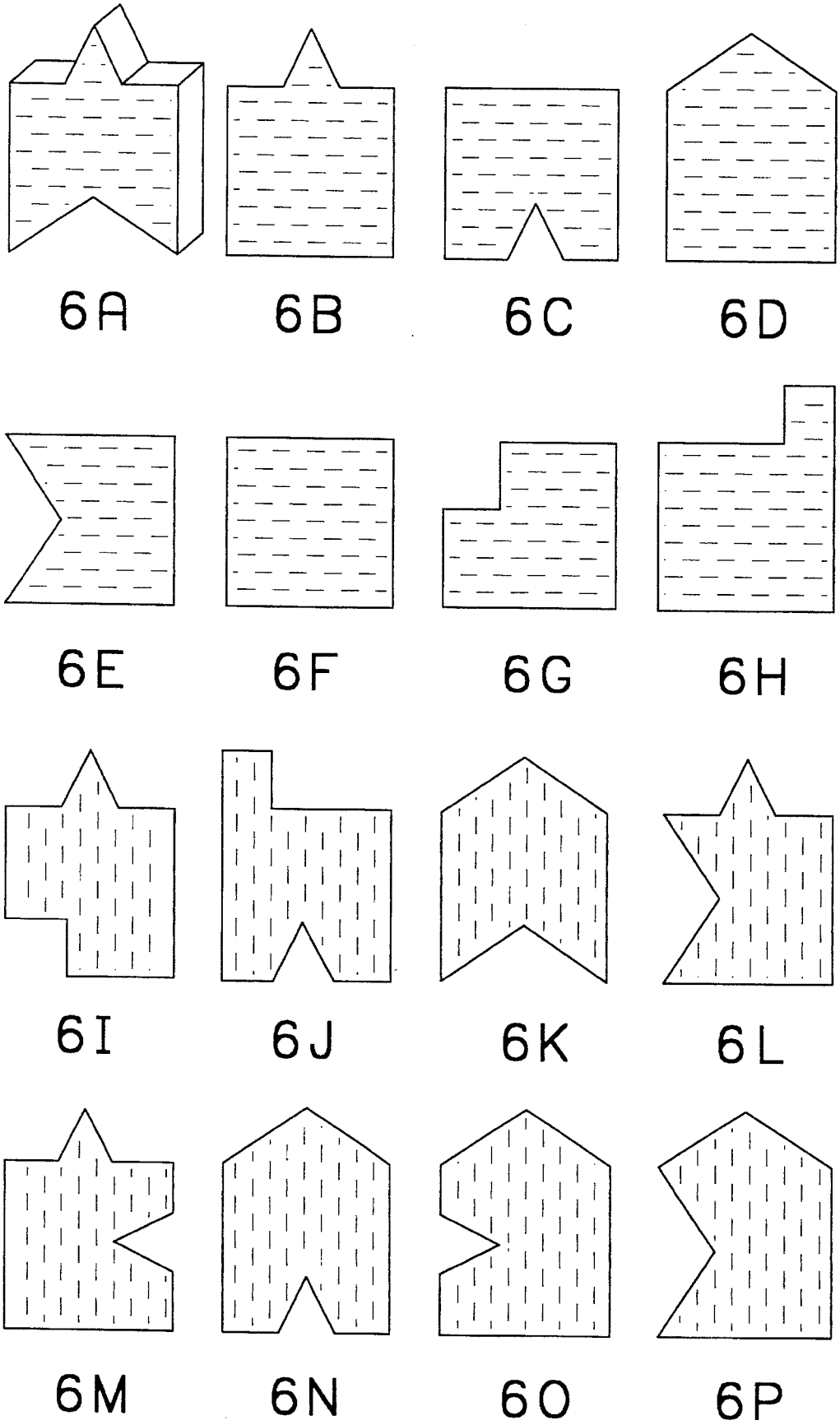
6A
6B
6C
6D
6E
6F
6G
6H
6I
6J
6K
6L
6M
6N
6O
6P

SHAPE IDENTIFICATION GAME USING SENSE OF TOUCH

The present invention relates to games, and in particular, to puzzle-type games having interlockable pieces which are assembled in predetermined configurations.

BACKGROUND OF THE INVENTION

Puzzle-type games are well known, and because of their familiarity, games incorporating puzzles are easily learned and suitable for group entertainment. It is the intent of the present invention to provide a game which can be played by a number of participants who will be in competition with one another, either individually or as team members, to complete a puzzle-type game.

BRIEF DESCRIPTION OF THE INVENTION

Briefly, the present invention is a game having a generally flexible enclosure in the form of a bag. The enclosure has a central cavity and a plurality of entry ports, each of which is in communication with the central cavity. In addition to the enclosure, the game includes a plurality of interlockable play pieces, which in the preferred embodiment have a block configuration with substantially square planar top and bottom surfaces and four substantially square sides. The surfaces of some of the sides of the blocks have contoured extensions or indentations which are suitable for mating with complementary shaped extensions or indentations on other of such play pieces. The game may also include a plurality of penalty pieces, each of which has a shape similar to a play piece but differentiated from play pieces by color. In the preferred embodiment, half the penalty pieces are black and half are white. In addition to the play pieces, the game includes a plurality of design cards, each design card depicting an assembly plan for assembling a plurality of the interlockable play pieces into a generally rectangular shape described as a "wall". There is further provided an even number of cylindrically shaped pieces, half of which are white in color, and the other half of which are black.

The game is played by first inserting all of the interlockable play pieces, the penalty pieces, and the cylindrical pieces within the flexible enclosure. Thereafter, each player or team of players selects a design card.

Each player inserts one hand into one of the ports of the enclosure, and using his sense of touch, identifies the interlockable play pieces which are required to assemble the rectangular pattern in accordance with the player's design card. Each player withdraws one play piece at a time and uses it to assemble a rectangularly shaped wall as depicted in his design card.

In the preferred embodiment, a player who selects a play piece which he cannot use as the next piece in his wall is required to pass the piece to the player or team to the right.

If a player selects a penalty piece, he must return it to the bag and select a cylindrical piece of the same color as the penalty piece before searching for the next play piece in his wall.

GENERAL DESCRIPTION OF THE DRAWINGS

A better and more complete understanding of the present invention can be had by a reading of the following description of a preferred embodiment taken in conjunction with the attached drawings wherein:

FIG. 2A is a perspective view and FIGS. 2B to 2P are front elevational views of interlockable block pieces for use in conjunction with the enclosure shown in FIG. 1;

FIG. 4 depicts a cylindrical piece used in conjunction with the game; and

FIG. 5 depicts a pyramid type piece also used in conjunction with the game, and FIG. 6A depicts a perspective view and FIGS. 6B to 6P depict front elevational views of penalty pieces where the cross-hatching is intended to denote colors which are different from the colors of the play pieces in FIGS. 2A to 2P.

DETAILED DESCRIPTION OF A PREFERRED EMBODIMENT

Figure 1:
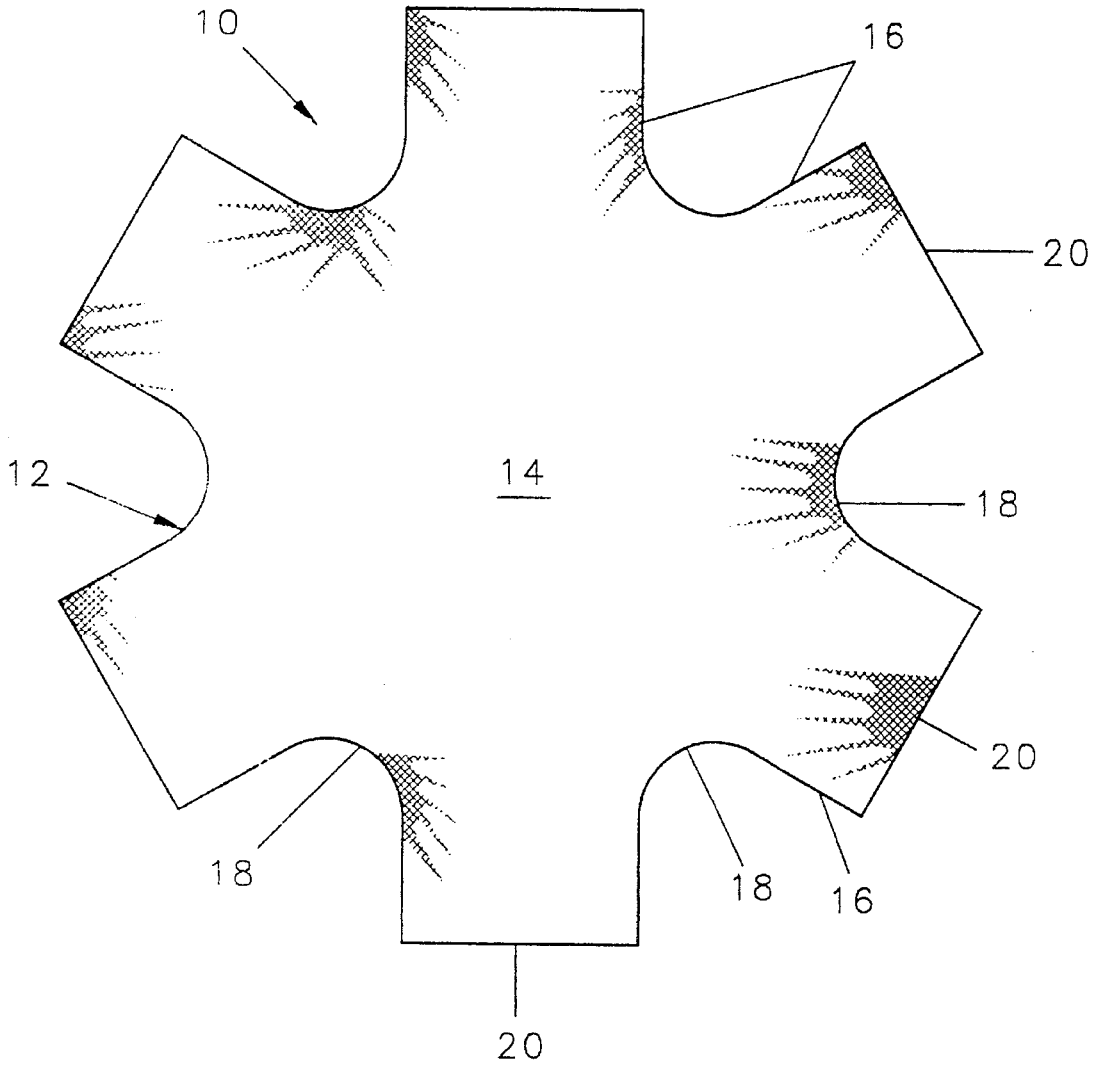
FIG. 1 is a top view of an enclosure for use with a game in accordance with the present invention.

The game in accordance with the present invention is played by concealing interlockable play pieces, as hereinafter described, within an enclosure, which in the preferred embodiment is a flexible bag. Referring to FIG. 1, the bag 10 is formed by attaching the edges of equally shaped upper and lower bag portions made of a flexible material such as cloth. In FIG. 1, the upper portion 12 of which is visible and is positioned over a similarly shaped lower portion. The bag portions 12 have an enlarged central section 14, which in the preferred embodiment is at least 18 inches in diameter, and extending radially outward of the central section 14 are a plurality of extensions 16—16. In the preferred embodiment, there are six extensions 16—16. The upper and lower sections 12 are sewed to each other along the U-shaped borders 18—18 which extend between the outer edges 20—20 of adjoining extension 16—16. In the preferred embodiment, the outer edges 20—20 of the extension 16—16 have a width of seven inches, such that the diameter of the opening formed thereby is about four inches. The greatest diameter of the bag, measured from opposing outer edges 20—20 is about 27 inches.

When the bag 10 is assembled, the extensions 16—16 form flexible sleeves which are open at the outer edges 20—20, and each sleeve has an open diameter of about four inches. The upper and lower central portions 14 of the bag 10 form a central cavity and the extensions form passageways communicating with the central cavity.

When the bag 10 is assembled as described above, the various pieces, as are hereinafter described, can be fitted into the central cavity of the bag 10. Thereafter, the upper portion 12 and lower portion of the bag 10 may be separated at the outer edges 20—20 of the extension 16—16 through which the player may insert his or her arm and reach his or her respective hand into the central cavity of the bag 10.

Referring to FIGS. 2A through 2P, the preferred embodiment of the game includes 16 distinct interlockable block play pieces bearing indicia numbers 22–37. FIG. 2A, depicts a piece 22 which has a generally cubically shaped body, as do all the block play pieces depicted in FIGS. 2A to 2P. Specifically, piece 22 has a substantially planar upper surface 40, a parallel lower surface 42 and side surfaces 44, 46, 48, 50.

Projecting midway along the length of side 44 of piece 22 is a wedge-shaped extension 52 having a sharply angled apex 54. On the opposing side 48 of the piece 22 is a wedge-shaped indentation 56 having an obtuse inner angle 58.

The remaining interlockable pieces 23–37 each have a generally cube-shaped body with substantially planar upper and lower surfaces, and four sides, all of which is substantially equal to the length of the sides of block 22. In the preferred embodiment, the body of each interlockable piece has a generally cubic shape with a dimension of ¾ inch on each of its edges.

Referring to FIG. 2B, one side of piece 23 also has a centered wedge-shaped extension 60 having a sharp angle at its apex equal to the angle 54 of projection 52 on the first piece 22. As can be seen in FIG. 2C, piece 24 has an indentation 62 on one of its sides 64, and the internal angle of the indentation 62 is complementary to the angle 54 at the apex of extensions 52 and 60 of pieces 22 and 23. The indentation 62 of piece 24 will, therefore, receive the extension of either piece 23 or 24, and piece 24 can interlock with either piece 23 or 24, respectively, by inserting the corresponding extension 52, 60 of piece 23 or 24, respectively, into the indentation 62 of piece 24.

Referring to FIG. 2D, one side of another piece 25 has a wedge-shaped side 66 with an obtuse apex-angle 68 complementary to the obtuse inner angle 58 of piece 22. Accordingly, piece 25 can interlock with piece 22 by inserting the wedge shaped side 66 of piece 25 into the recess 56 of piece 22. Referring to FIG. 2E, piece 26 has a wedge-shaped indentation 70 with an obtuse angle equal to angle 58, and piece 26 can be interlocked with piece 25 by fitting the wedge shaped side 66 of piece 25 into the indentation 70 of piece 26. In FIG. 2F, piece 27 is a cube, that is, all sides are square and piece 27 can be mated against a square side of any other piece. Piece 28, shown in FIG. 2G has a rectangular portion removed from one corner such that piece 28, as viewed from the top, has an indentation at one corner defined by perpendicular flat surfaces 72 and 74. Piece 29, as viewed from the top, has a rectangular projection 76 extending along one of its sides, and the projection 76 is complementary and shaped to the indentation formed by surfaces 72 and 74 of piece 28. Consequently, piece 29 can be interlocked with piece 28 by inserting the projection 76 of piece 29 into the indentation of piece 28 formed by surfaces 72 and 74.

FIG. 2I depicts piece 30 which has an indentation on one corner formed by perpendicular surfaces 78 and 80. Positioned midway along another side is a wedge-shaped extension 82 similar to the extension 52 on piece 22. Piece 2J has a rectangularly shaped extension 84 along one side thereof, and centered in the opposing side, an indentation 86 similar to indentation 62 of piece 24. Piece 32, shown in FIG. 2K, has a wedge-shaped projection 88 on one side thereof with an obtuse apex angle equal to angle 68 of piece 25 and on the opposing side thereof an indentation 90 similar to the indentations 56 of piece 22.

Piece 33 shown in FIG. 2L has an indentation 90 on one side thereof similar to the indentation 56 on piece 22 and midway along an adjacent side a wedge-shaped projection 92 similar to projection 52 of piece 22. Piece 34, shown in FIG. 2M has a projection 94 extending from midway along one side thereof which is similar to the extension 52 of piece 22, and midway along an adjacent side an indentation 94 which is similar to the indentation 62 of piece 24. Piece 35, shown in FIG. 2N, has a projection 98 along one side thereof having an obtuse angle equal to angle 68 of piece 25, and centered on the opposing side a wedge shaped indention 96 similar to the indentation 62 of piece 24. Piece 36, shown in FIG. 20, also has a wedge-shaped projection 102 on one side thereof with the apex having an obtuse angle equal to angle 68 of piece 25, and further having a wedge shaped indentation 100 in an adjacent side similar to the indentation 62 of piece 24. Finally, piece 37, shown in FIG. 2P, has a wedge-shaped projection 104 on one side, the apex of which is an obtuse angle similar to the projection 66 of piece 25 and on an adjacent side a complementary indentation 106 similar to the indentation 70 of piece 26.

Altogether, there are sixteen distinct configurations of interlockable play pieces, and in the preferred embodiment there are seven copies of each interlockable play piece for a total of 112 play pieces. As shown in FIGS. 6A to 6P one copy of each configuration of play pieces is designated as a penalty piece. In the preferred embodiment, there are eight penalty pieces shown in FIGS. 6A to 6H which are shaded to depict that they are painted white and eight penalty pieces shown in FIGS. 6I to 6P which are shaded to depict that they are painted black.

Figure 3A:
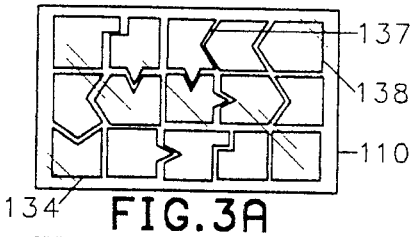
FIGS. 3A to 3U depict design cards, each of which designates a predetermined assembly plan for interlocking certain of the interlockable pieces to form a generally rectangular shape.
Figure 3B:
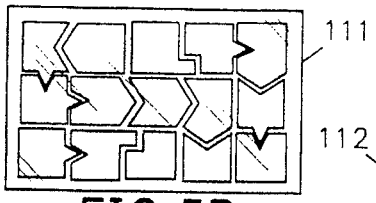
Figure 3C:
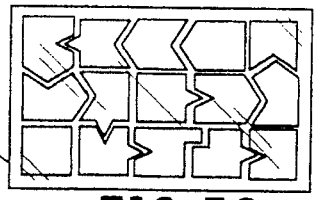
Figure 3D:
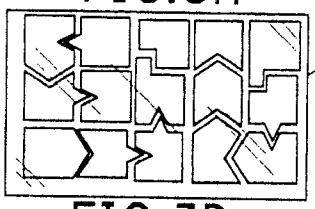
Figure 3E:
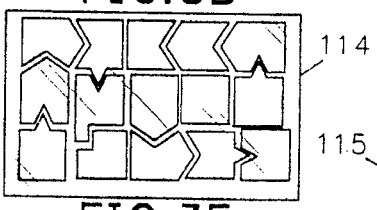
Figure 3F:
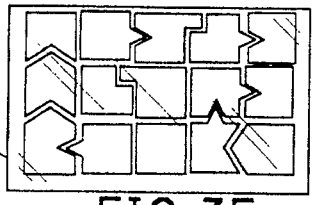
Figure 3G:
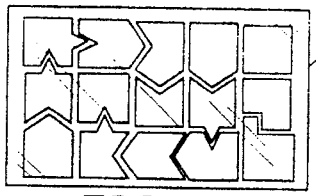
Figure 3H:
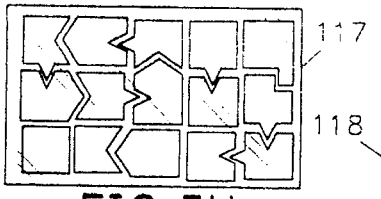
Figure 3I:
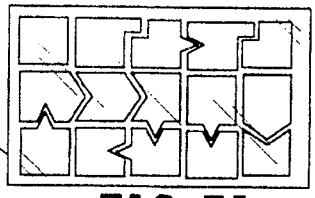
Figure 3J:
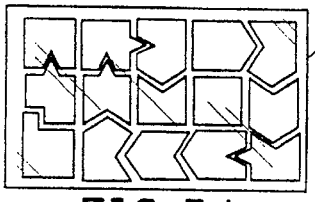
Figure 3K:
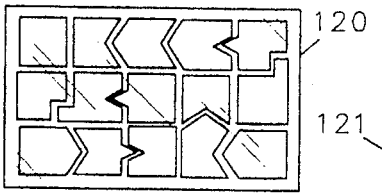
Figure 3L:
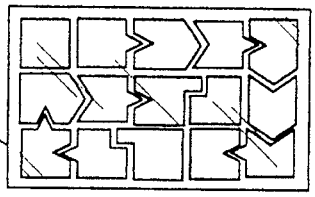
Figure 3M:
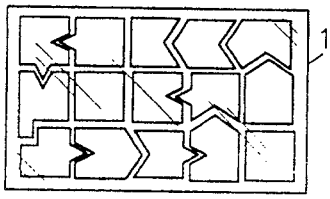
Figure 3N:
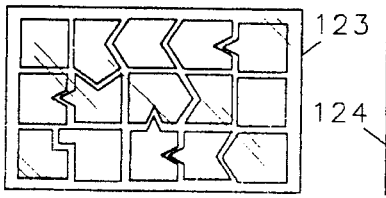
Figure 3O:
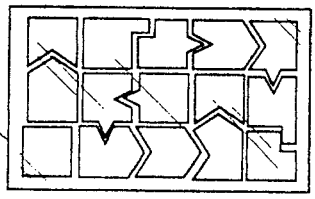
Figure 3P:
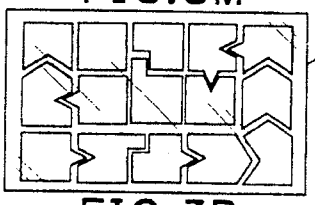
Figure 3Q:
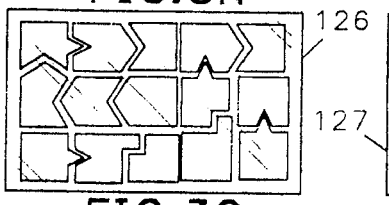
Figure 3R:
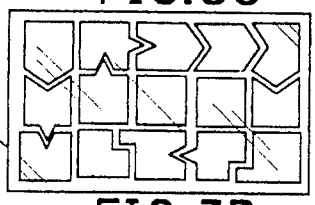
Figure 3S:
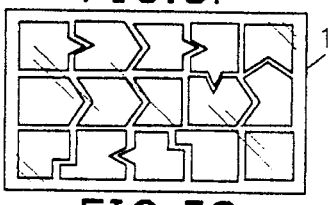
Figure 3T:
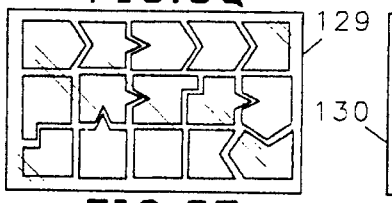
Figure 3U:
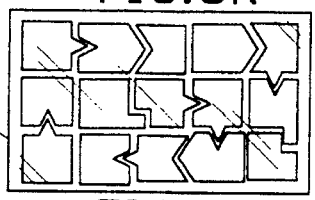

Because the indentations of one of the above described pieces will receive a complementary shaped projection from another of such pieces, the pieces 22–37 can be assembled to reach a generally rectangular configuration or wall. Referring to FIG. 3A through 3U, the game of the present invention further includes a plurality of 21 design cards, numbered 110 to 130, one of which is depicted in each of the lettered FIGS. 3A through 3U. Each of the design cards 3A to 3U depicts a unique assembly plan of fifteen play pieces to form a rectangularly shaped wall. The interlockable pieces 22–37 can be assembled to reach anyone of the walls depicted in FIGS. 3A through 3U.

Referring to FIG. 4, the game also includes a plurality of cylindrical pegs 140. In the preferred embodiment, there are six cylindrical pegs, three white and three black. Finally, the game also includes a plurality of other tokens such as pyramid shaped pieces 142. In the preferred embodiment there are at least seven tokens 142.

The game is best played by six participants forming three teams of two players each, however, the game may also be played by four players forming two teams of two players each. Alternately, the game can be played by two to six players without team members.

First, the 112 interlockable play pieces 22–37 are inserted into the central cavity 14 of the bag 10 along with the six cylindrical pieces 140 and the pieces are scrambled. Then, each player or team of players selects one design card 110 to 131. Thereafter, each player places one hand through one of the openings at the outer edges 20—20 of the bag 10 and searches using his or her sense of touch through the assortment of pieces to select the piece corresponding to the left bottom piece as shown on his or her design card. The piece is then removed from the bag and placed on a table or other flat surface to assemble the wall depicted in his or her design card. The player or team of players then searches for a second piece which corresponds to the piece immediately to the right of the first piece as shown in his design card, again using his or her sense of touch from within the bag and positions the second piece to assemble a wall as shown in his selected design card. Team members, or individual players, are prohibited from withdrawing more than one play piece at a time, and if a piece is withdrawn which cannot be used as the next piece to be interlocked in accordance with the design card, the piece must be offered to the player or team of players to the immediate right as a penalty, and if the player to the right can make use of the block offered anywhere in his or her wall, that player may do so without interrupting his own search for play pieces. If the piece cannot be used by the player to the right, it is returned to the bag.

Also, if a player withdraws one of the penalty pieces from the bag, the penalty piece cannot be used to construct the player's wall. The penalty piece in the preferred embodiment is colored either black or white. The player must return the penalty piece to, the bag and thereafter withdraw from the bag a cylindrical peg 140 having the same color as the penalty piece which was selected before searching for the next piece for his wall.

In the preferred embodiment, the winning team is required to win three rounds and receives a token 142 for each round one. Upon winning three tokens, the player or team has won the game. In case of a tie, that is, when two or more teams have completed their respective walls in substantially the same time, the tie can be broken by each team searching the bag for a white peg. The party to first find a white peg will break the tie.

There is, therefore, described a game which can be played by various team members, and accommodate at least three teams of two players each. The game is easily learned and played and utilizes the player's sense of touch, a bag and puzzle-type interlockable play pieces.

While the present invention has been described in connection with one embodiment, it will be understood by those skilled in the art that many changes and modifications may be made without departing from the true spirit and scope of the game. Therefore, it is intended by the appended claims to cover all such changes and modifications which come within the true spirit and scope of the game.

What is claimed:

1. A game comprising in combination a flexible enclosure having a central cavity and a plurality of entry ports communicating with said central cavity, a plurality of distinct play pieces adapted for insertion into said central cavity, a first portion of said plurality of play pieces each having a projection thereon, a second portion of said plurality of play pieces each having an indentation thereon, each of said indentations complementary in shape to the shape of at least one of said projections, and said indentations and projections for interlockable assembly of members of said first portion and members of said second portion to form a wall.

2. The game of claim 1 wherein said play pieces are interlockable.

3. The game in accordance with claim 1 further comprising a plurality of penalty pieces, each of said penalty pieces shaped like one of said play pieces.

4. The game in accordance with claim 3 wherein said penalty pieces are of a different color from said play pieces so as to be distinguished therefrom.

5. The game in accordance with claim 4 and further comprising a plurality of different assembly plans for assembling said play pieces to form a wall.

6. The method of playing a game by a plurality of game players comprising the steps of:

providing an enclosure for retaining a plurality of play pieces, providing a plurality of interlockable distinct play pieces, inserting said play pieces in said enclosure, each of said game players inserting a hand into said enclosure and withdrawing a second plurality of at least three of said play pieces one at a time from said enclosure, providing a plurality of assembly plans, each of said assembly plans displaying a configuration for interlocking said second plurality of play pieces, and each of said players assembling said withdrawn play pieces in accordance with one of said assembly plans.

7. The method of claim 6 and further comprising the steps of providing a plurality of penalty pieces wherein each of said penalty pieces is shaped like one of said play pieces, inserting said penalty pieces in said enclosure along with said play pieces, and said players who withdraw one of said penalty pieces, returning said one of said penalty pieces withdrawn to said enclosure.

* * * * *